US007198458B2

(12) United States Patent
Thompson

(10) Patent No.: US 7,198,458 B2
(45) Date of Patent: Apr. 3, 2007

(54) FAIL SAFE COOLING SYSTEM FOR TURBINE VANES

(75) Inventor: Daniel G. Thompson, Pittsburgh, PA (US)

(73) Assignee: Siemens Power Generation, Inc., Orlando, FL (US)

( * ) Notice: Subject to any disclaimer, the term of this patent is extended or adjusted under 35 U.S.C. 154(b) by 92 days.

(21) Appl. No.: 11/002,029

(22) Filed: Dec. 2, 2004

(65) Prior Publication Data

US 2006/0120871 A1 Jun. 8, 2006

(51) Int. Cl.
*F01D 5/18* (2006.01)

(52) U.S. Cl. ..... 415/115; 415/177; 416/97 R; 416/229 R

(58) Field of Classification Search ..... 415/115, 415/176, 177; 416/97 R, 97 A, 229 R, 232
See application file for complete search history.

(56) References Cited

U.S. PATENT DOCUMENTS

| | | | | |
|---|---|---|---|---|
| 3,301,526 | A | 1/1967 | Chamberlain | |
| 3,378,228 | A | 4/1968 | Davies et al. | |
| 3,515,499 | A | 6/1970 | Beer et al. | |
| 3,554,663 | A | 1/1971 | Helms | |
| 3,584,972 | A | 6/1971 | Bratkovich | |
| 3,606,573 | A | 9/1971 | Emmerson et al. | |
| 3,619,077 | A | 11/1971 | Wile et al. | |
| 3,698,834 | A | 10/1972 | Meginnis | |
| 3,778,183 | A | 12/1973 | Luscher et al. | |
| 3,872,563 | A | 3/1975 | Brown et al. | |
| 4,105,364 | A | 8/1978 | Dodd | |
| 4,180,371 | A | 12/1979 | Ivanko | |
| 4,221,539 | A | 9/1980 | Corrigan | |
| 4,260,326 | A | 4/1981 | Scott et al. | |
| 4,314,794 | A | 2/1982 | Holden et al. | |
| 4,504,189 | A | 3/1985 | Lings | |
| 4,529,357 | A * | 7/1985 | Holland | 416/97 R |
| 4,770,608 | A | 9/1988 | Anderson et al. | |
| 5,306,554 | A | 4/1994 | Harrison et al. | |
| 5,484,258 | A * | 1/1996 | Isburgh et al. | 415/115 |
| 5,702,232 | A | 12/1997 | Moore | |
| 6,206,638 | B1 | 3/2001 | Glynn et al. | |
| 6,224,339 | B1 | 5/2001 | Rhodes et al. | |
| 6,235,370 | B1 | 5/2001 | Merrill et al. | |
| 6,322,322 | B1 | 11/2001 | Rhodes et al. | |

(Continued)

FOREIGN PATENT DOCUMENTS

| | | | |
|---|---|---|---|
| EP | 0140257 | A1 | 5/1985 |

(Continued)

*Primary Examiner*—Igor Kershteyn

(57) ABSTRACT

Embodiments of the invention relate to a turbine vane having a fail safe cooling system. According to embodiments of the invention, the vane can have multiple concentric layers of radial cooling holes extending about the vane; each layer being fluidly connected to the adjacent layer or layers. Such fluid communication can occur through one or more plenums in the vane or in the shrouds bounding the radial ends of the vane. Coolant can initially be supplied to the innermost layer of cooling holes. From there, the coolant can sequentially progress through successive outer layers. Between two adjacent layers, the coolant can flow in opposite directions. Not only does such a system provide needed cooling to the vane, but the multilayer redundant cooling system can avoid or delay catastrophic failures that can occur if the vane surface is damaged, such as by impact.

19 Claims, 4 Drawing Sheets

U.S. PATENT DOCUMENTS

| | | | | |
|---|---|---|---|---|
| 6,390,774 | B1 | 5/2002 | Lewis et al. | |
| 6,398,501 | B1 | 6/2002 | Darkins, Jr. et al. | |
| 6,478,535 | B1 * | 11/2002 | Chung et al. | 415/115 |
| 6,506,022 | B2 | 1/2003 | Bunker | |
| 6,574,966 | B2 | 6/2003 | Hidaka et al. | |
| 6,589,010 | B2 | 7/2003 | Itzel et al. | |
| 6,648,600 | B2 | 11/2003 | Takahashi et al. | |
| 6,670,046 | B1 | 12/2003 | Xia | |
| 2003/0059305 | A1 | 3/2003 | Bather et al. | |

FOREIGN PATENT DOCUMENTS

| | | | |
|---|---|---|---|
| EP | 1001137 | A2 | 5/2000 |
| EP | 1065343 | A2 | 1/2001 |
| EP | 1091092 | A2 | 4/2001 |
| EP | 1239119 | A1 | 9/2002 |
| EP | 1245786 | A2 | 10/2002 |
| EP | 1267038 | A2 | 12/2002 |
| EP | 1319803 | A2 | 6/2003 |
| EP | 1361337 | A1 | 11/2003 |
| EP | 1367223 | A2 | 12/2003 |
| JP | 59113204 | A2 | 6/1984 |
| WO | WO 01/12361 | A2 | 2/2001 |
| WO | WO 03/026887 | A2 | 4/2003 |
| WO | WO 03/042503 | A1 | 5/2003 |

* cited by examiner

FAIL SAFE COOLING SYSTEM FOR TURBINE VANES

FIELD OF THE INVENTION

The invention relates in general to turbine engine and, more specifically, to a cooling system for stationary airfoils in a turbine engine.

BACKGROUND OF THE INVENTION

During the operation of a turbine engine, turbine vanes, among other components, are subjected to the high temperatures of combustion. In order to withstand such an environment, the vanes must be cooled. The prior art is replete with examples of cooling systems for turbine vanes; however, these cooling systems are not sufficiently robust in the event of damage to the outer surface of the vane, such as from impact with an object. Damage to the vane exterior can cause such cooling systems to fail, which, in turn, can quickly cascade into substantial structural damage. Thus, there is a need for a robust cooling system that can avoid or at least delay catastrophic failures that can follow vane surface damage.

SUMMARY OF THE INVENTION

Aspects of the invention relate to a fail safe cooling system for a turbine vane. The turbine vane has an outer radial end and an inner radial end. In addition, the vane has an outer peripheral surface that defines an outer vane profile. A first layer of cooling holes extend substantially radially between the inner radial end and the outer radial end of the vane. The first layer of cooling holes are arranged along at least a portion of the vane.

Similarly, a second layer of cooling holes extend substantially radially between the inner radial end and the outer radial end of the vane. The second layer of cooling holes are arranged along at least a portion of the vane. The second layer of cooling holes are in fluid communication with the first layer of cooling holes near one of the radial ends. The second layer of cooling holes is closer to the outer peripheral surface of the vane than the first layer. Further, the first and second layers of cooling holes can be substantially concentric. Thus, a coolant can pass sequentially from the first layer to the second layer of cooling holes. The direction of coolant flow through the first layer can be opposite to the direction of coolant flow through the second layer.

The vane can be a single-piece construction. Alternatively, the vane can be formed by a plurality of laminates that are radially stacked. Each laminate can have an airfoil-shaped outer peripheral surface. Each laminate can have a planar direction and a radial direction; the radial direction can be substantially normal to the planar direction. Each laminate can be made of an anisotropic ceramic matrix composite (CMC) material such that the planar tensile strength of each laminate is substantially greater than the radial tensile strength of the laminate.

In one embodiment, the system can further include a third layer of cooling holes that extend between the inner radial end and the outer radial end of the vane. The third layer of cooling holes can be in fluid communication with the second layer of cooling holes. The third layer of cooling holes can be arranged along at least a portion of the vane. The third layer of cooling holes can be closer to the outer peripheral surface of the vane than the second layer of cooling holes. In such an arrangement, a coolant can pass sequentially from the first layer to the second layer to the third layer of cooling holes. The direction of coolant flow through the second layer can be opposite to the direction of coolant flow through the first and third layers.

In one embodiment, a fourth layer of cooling holes can be provided. The fourth layer can extend between the inner radial end and the outer radial end of the vane. The fourth layer of cooling holes can be in fluid communication with the third layer of cooling holes. The fourth layer of cooling holes can be arranged along at least a portion of the vane. Relative to the third layer, the fourth layer of cooling holes can be closer to the outer peripheral surface of the vane. Thus, a coolant can pass sequentially through the first, second, third and fourth layers of cooling holes. The direction of coolant flow through the second and fourth layers can be opposite to the direction of coolant flow through the first and third layers. Additional layers of cooling holes can be provided.

One or more coolant supply passages can be provided in the vane. The passages can extend radially from the inner radial end toward the inner radial end of the vane. The coolant supply passages can be spaced inward from the first layer of cooling holes, and the coolant supply passages can be in fluid communication with the first layer of cooling holes. The vane can provide at least one passage near its radial inner end for permitting fluid communication between the coolant supply passage and the first layer of cooling holes. Further, the vane can provide at least one passage near its radial outer end for permitting fluid communication between the first and second layers of cooling holes.

The vane can be bounded at its inner radial end by an inner shroud. The coolant supply passage and the first layer of cooling holes can extend through the radial inner end of the vane. In such case, the inner shroud can provide at least one plenum for permitting fluid communication between the coolant supply passage and the first layer of cooling holes.

Likewise, the vane can be bounded at its outer radial end by an outer shroud. The first and second layers of cooling holes can extend through the radial outer end of the vane. In one embodiment, the outer shroud can provide a single plenum for permitting fluid communication between the first and second layers of cooling holes. In another embodiment, the outer shroud can provide two or more plenums. A first group of cooling holes in the first and second layers can be in fluid communication through a first plenum; a second group of cooling holes in the first and second layers can be in fluid communication through a second plenum. In another embodiment, each individual cooling hole in the first layer can be in fluid communication with an individual cooling hole in the second layer through a respective individual plenum provided in the outer shroud.

The vane can include a trailing edge. At least one of the cooling holes in the second layer can include a plurality of channels branching therefrom. These channels can extend through the trailing edge of the vane to provide cooling to the trailing edge of the vane.

Aspects of the invention relate to a fail safe cooling system for a stacked laminate CMC vane assembly. The vane has an outer radial end, an inner radial end and an outer peripheral surface. At least one coolant supply passage extends radially through the vane. The vane is formed by a plurality of laminates that have an airfoil-shaped outer peripheral surface. The laminates are radially stacked so as to define the turbine vane. Each laminate is made of an anisotropic ceramic matrix composite (CMC) material. Each laminate has a planar direction and a radial direction that is substantially normal to the planar direction. The planar tensile strength of each laminate is substantially greater than the radial tensile strength of the laminate. An outer shroud bounds the vane at its outer radial end, and an inner shroud bounds the vane at its inner radial end. A fastener can be received in the coolant supply passage to maintain the laminate stack in radial compression.

A first layer of cooling holes extend radially through the vane. The first layer of cooling holes are arranged about at least a portion of the vane. The first layer of cooling holes are in fluid communication with the one or more coolant supply passages by way of one or more plenums provided in the inner shroud. A second layer of cooling holes extend radially through the vane. The second layer of cooling holes are arranged about at least a portion of the vane. The second layer of cooling holes are in fluid communication with the first layer of cooling holes through at least one plenum in the outer shroud. Compared to the first layer, the second layer of cooling holes is closer to the outer peripheral surface of the vane. In such a vane, a coolant can pass sequentially from the first layer to the second layer of cooling holes. The direction of coolant flow through the first layer can be opposite to the direction of coolant flow through the second layer.

A third layer of cooling holes can extend between the inner radial end and the outer radial end of the vane. The third layer of cooling holes can be in fluid communication with the second layer of cooling holes through at least one plenum in the inner shroud. The third layer of cooling holes can be arranged about at least a portion of the vane. The third layer of cooling holes can be closer to the outer peripheral surface of the vane than the second layer. In such an arrangement, a coolant can pass sequentially from the first layer to the second layer to the third layer of cooling holes. The direction of coolant flow through the second layer can be opposite to the direction of coolant flow through the first and third layers.

The vane can have a trailing edge. In one embodiment, a plurality of exit passages can be formed in the trailing edge of the vane. The exit passages can extend in substantially the planar direction. In such case, the second layer of cooling holes can be in fluid communication with the trailing edge exit passages by way of at least one plenum in the inner shroud. In another embodiment, one or more pairs of cooling holes from the first and second layers can be positioned proximate the trailing edge. The cooling hole of the second layer can include a plurality of exit passages extending therefrom and through the trailing edge.

DETAILED DESCRIPTION OF EMBODIMENTS OF THE INVENTION

Embodiments of the present invention address the drawbacks of prior vane cooling systems by providing a robustness to vane surface damage. Embodiments of the invention will be explained in the context of one possible turbine vane, but the detailed description is intended only as exemplary. Embodiments of the invention are shown in FIGS. 1A–4, but the present invention is not limited to the illustrated structure or application.

Figure 1A:
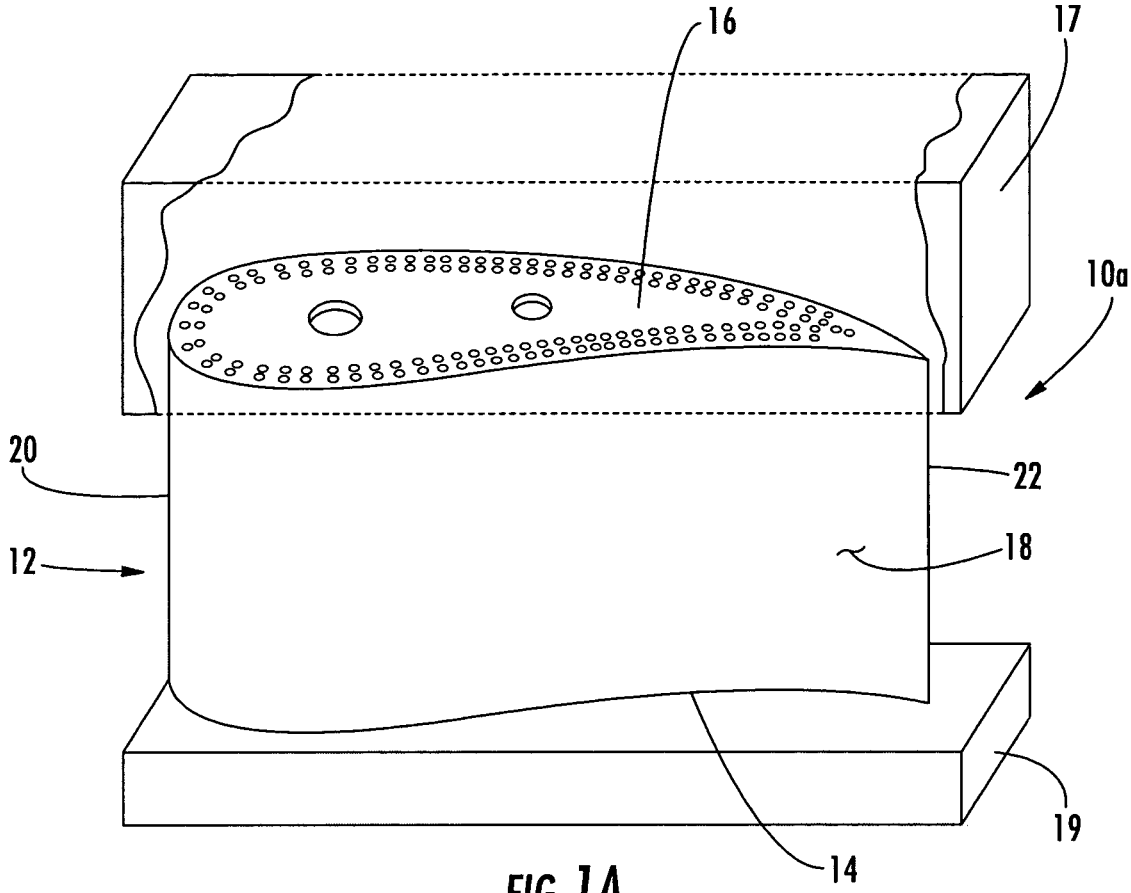
FIG. 1A is an isometric view of a single body turbine vane having a cooling system according to embodiments of the invention.
Figure 1B:
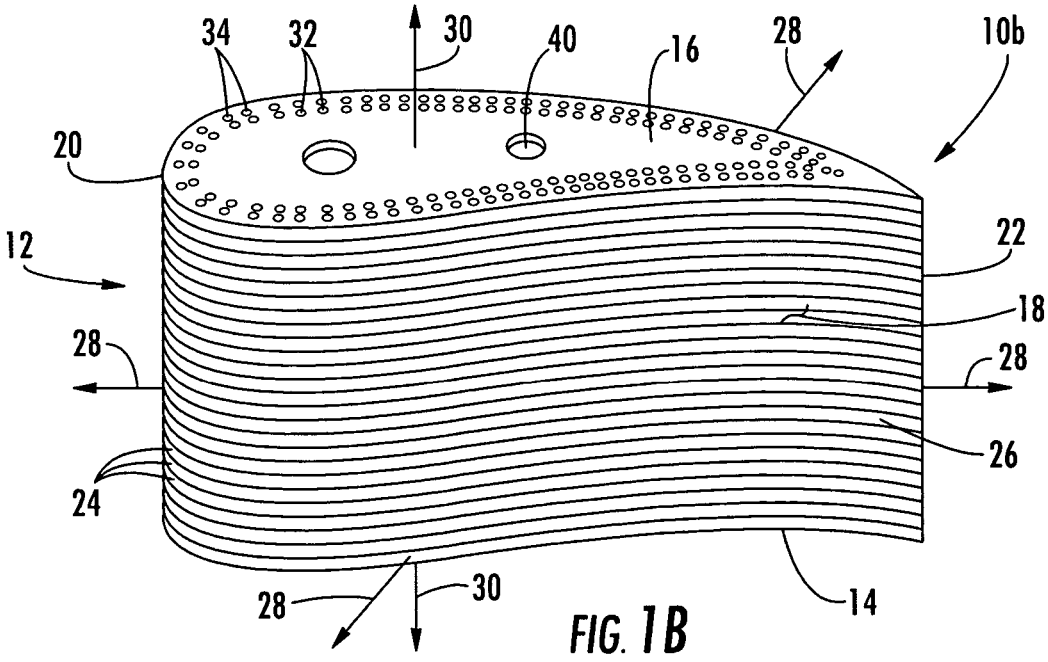
FIG. 1B is an isometric view of stacked wafer turbine vane having a cooling system according to embodiments of the invention.

The cooling system according to embodiments of the invention is applicable to a variety of turbine vane designs including a single body construction 10*a* (FIG. 1A) and a stacked wafer construction 10*b* (FIG. 1B). In either construction, the vane 12 can have a radial inner end 14, a radial outer end 16, and an outer peripheral surface 18. The term "radial" as used herein is intended to describe the direction of the vane 12 in its operational position relative to the turbine. A turbine vane 12 can be bounded at its radial outer end 16 by an outer shroud 17 and at its radial inner end 14 by an inner shroud 19. Further, the vane 12 can have a leading edge 20 and a trailing edge 22.

The single body construction 10*a* generally refers to vanes that are unitary structures or are otherwise made of relatively few individual components. Single body construction is conventional in the art. A single body vane can be made of a variety of materials including ceramics, ceramic matrix composites and metals.

In a stacked wafer construction 10*b*, the vane 12 can be made of a plurality of radially stacked wafers 24, which can be laminates. The individual wafers 24 can have an airfoil-shaped outer peripheral surface 26 such that when the wafers 24 are stacked, they form the outer peripheral surface 18 of the vane 12. The term "airfoil-shaped" is intended to refer to the general shape of an airfoil cross-section, and embodiments of the invention are not limited to any specific airfoil shape. Each wafer 24 can have an in-plane direction 28 and a through thickness direction 30; the through thickness direction 30 can be substantially normal to the in-plane direction 28. The in-plane direction 28 generally refers to the any of a number of directions extending through the edgewise thickness of the wafer 24.

The wafers 24 can be made of various materials including ceramics or ceramic matrix composites. Preferably, each wafer 24 is a laminate made of a ceramic matrix composite (CMC) material. A CMC material comprises a ceramic matrix that hosts a plurality of reinforcing fibers. The CMC material can be anisotropic at least in the sense that it can have anisotropic strength characteristics.

A CMC laminate having anisotropic strength characteristics according to embodiments of the invention can be made of a variety of materials, and embodiments of the invention are not limited to any specific materials so long as the target anisotropic properties are obtained. In one embodiment, the CMC can be from the oxide-oxide family. In one embodiment, the ceramic matrix can be, for example, alumina. The fibers can be any of a number of oxide fibers. In one embodiment, the fibers can be made of Nextel™ 720, which is sold by 3M, or any similar material. The fibers can be provided in various forms, such as a woven fabric, blankets, unidirectional tapes, and mats. A variety of techniques are known in the art for making a CMC material, and such techniques can be used in forming a CMC material having strength directionalities in accordance with embodiments of the invention.

In addition to fiber material, the strength properties of a CMC laminate can be affected by fiber direction. In a CMC laminate according to embodiments of the invention, the fibers can be arranged to provide the vane assembly 10*b* with the desired anisotropic strength properties. More specifically, the fibers can be oriented in the laminate to provide strength or strain tolerance in the direction of high thermal stresses or strains. To that end, substantially all of the fibers can be provided in the in-plane direction 28 of the laminate; however, a CMC material according to embodiments of the invention can have some fibers in the through thickness direction 30 as well. "Substantially all" is intended to mean all of the fibers or a sufficient majority of the fibers so that the desired strength properties are obtained.

The fibers of the CMC laminate can be substantially uni-directional, substantially bi-directional or multi-directional. In a bi-directional laminate, one portion of the fibers can extend at one angle relative to the chord line of the laminate and another portion of the fibers can extend at a different angle relative to the chord line of the laminate such that the fibers cross. A preferred bi-directional fiber network includes fibers that are oriented at about 90 degrees relative to each other, but other relative orientations are possible, such as at about 30 or about 60 degrees. In one embodiment, a first portion of the fibers can be oriented at about 45 degrees relative to the chord line of the laminate, while a second portion of the fibers can be oriented at about −45 degrees (135 degrees) relative to the chord line. Other possible relative fiber arrangements include: fibers at about 30 and about 120 degrees, fibers at 60 and 150 degrees, and fibers at about 0 degrees and about 90 degrees relative to the chord line. These orientations are given in the way of an example, and embodiments of the invention are not limited to any specific fiber orientation. Indeed, the fiber orientation can be optimized for each application depending at least in part on the cooling system, temperature distributions and the expected stress field for a given vane.

As noted earlier, the fibers can be substantially unidirectional, that is, all of the fibers or a substantial majority of the fibers can be oriented in a single direction. For example, the fibers in one laminate can all be substantially aligned at, for example, 45 degrees relative to the chord line. In such case, it is preferred if at least one of the adjacent laminates is also substantially uni-directional with fibers oriented at about 90 degrees in the opposite direction. For example, the laminate can include fibers oriented at about −45 degrees (135 degrees) relative to the chord line. In the context of a vane assembly 10*b*, such alternation can repeat throughout the vane assembly or can be provided in local areas.

Aside from the particular materials and the fiber orientations, the CMC laminates according to embodiments of the invention can be defined by their anisotropic properties. For example, the laminates can have a tensile strength in the in-plane direction 28 that is substantially greater than the tensile strength in the through thickness direction 30. In one embodiment, the in-plane tensile strength can be at least three times greater than the through thickness tensile strength. In another embodiment, the ratio of the in-plane tensile strength to the through thickness tensile strength of the CMC laminate can be about 10 to 1. In yet another embodiment, the in-plane tensile strength can be from about 25 to about 30 times greater than the through thickness tensile strength.

One particular CMC laminate according to embodiments of the invention can have an in-plane tensile strength from about 150 megapascals (MPa) to about 200 MPa in the fiber direction and, more specifically, from about 160 MPa to about 184 MPa in the fiber direction. Further, such a laminate can have an in-plane compressive strength from about 140 MPa to 160 MPa in the fiber direction and, more specifically, from about 147 MPa to about 152 MPa in the fiber direction.

This particular CMC laminate can be relatively weak in tension in the through thickness direction. For example, the through thickness tensile strength can be from about 3 MPa to about 10 MPa and, more particularly, from about 5 MPa to about 6 MPa, which is substantially lower than the in-plane tensile strengths discussed above. However, the laminate can be relatively strong in compression in the through thickness direction. For example, the through thickness compressive strength of a laminate according to embodiments of the invention can be from about −251 MPa to about −314 MPa. The above quantities are provided merely as examples, and embodiments of the invention are not limited to any specific strengths in the in-plane or through thickness directions.

While the terms "in-plane" and "through thickness" are helpful in describing the anisotropic strength characteristics of an individual CMC laminate, such terms may become awkward when used to describe strength directionalities of an entire turbine vane 12 formed by a plurality of stacked laminates according to embodiments of the invention. For instance, the "in-plane direction" associated with an individual laminate generally corresponds to the axial and circumferential directions of the vane assembly 10 in its operational position relative to the turbine. Similarly, the "through thickness direction" generally corresponds to the radial direction of the vane assembly 10 relative to the turbine. Thus, a turbine vane 12 formed by a plurality of stacked laminates 24 according to the invention can have a tensile strength in the planar direction 28 that is substantially greater than the tensile strength in the radial direction 30.

Figure 2A:
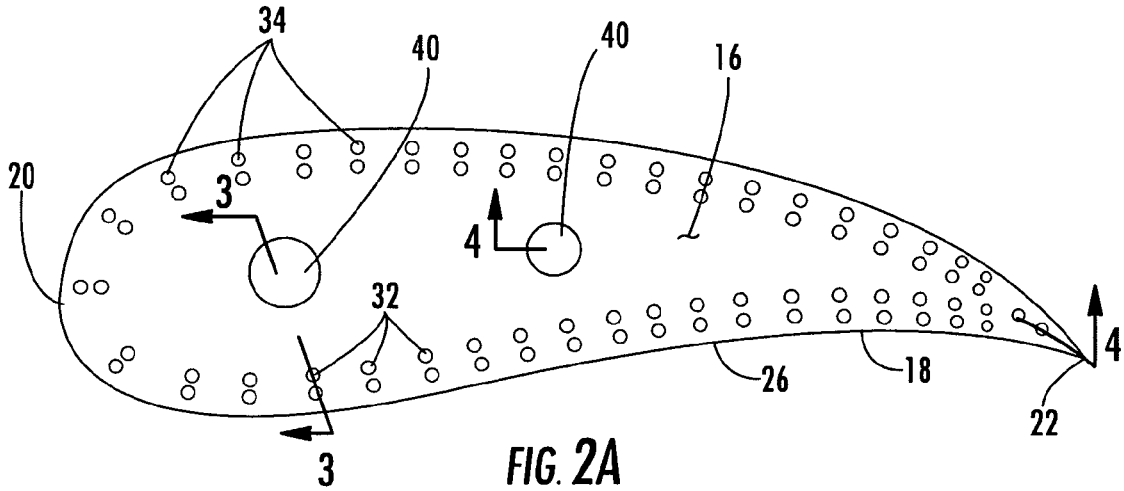
FIG. 2A is a top plan view of a two layer cooling hole arrangement for a turbine vane according to embodiments of the invention.

The fail safe cooling system according to embodiments of the invention can include at least two layers of cooling holes extending substantially radially through the vane 12. In one embodiment, there can be two layers of cooling holes: a first layer of cooling holes 32 and a second layer of cooling holes 34, as shown in FIG. 2A. To facilitate discussion, a two layer cooling system will be described, but aspects of the invention are not limited to a two layer system. The first layer of cooling holes 32 can extend substantially radially between the inner radial end 14 and the outer radial end 16 of the vane 12. The first layer of cooling holes 32 can be arranged about at least a portion of the vane 12. In one embodiment, the first layer of cooling holes 32 can extend about the entire vane 12, generally following the contours of the outer peripheral surface 18 of the vane 12, as is shown in FIG. 2A. However, in some instances, the first layer 32 may only extend about a portion of the vane 12, such as around the leading edge 20 or the trailing edge 22.

Figure 2B:
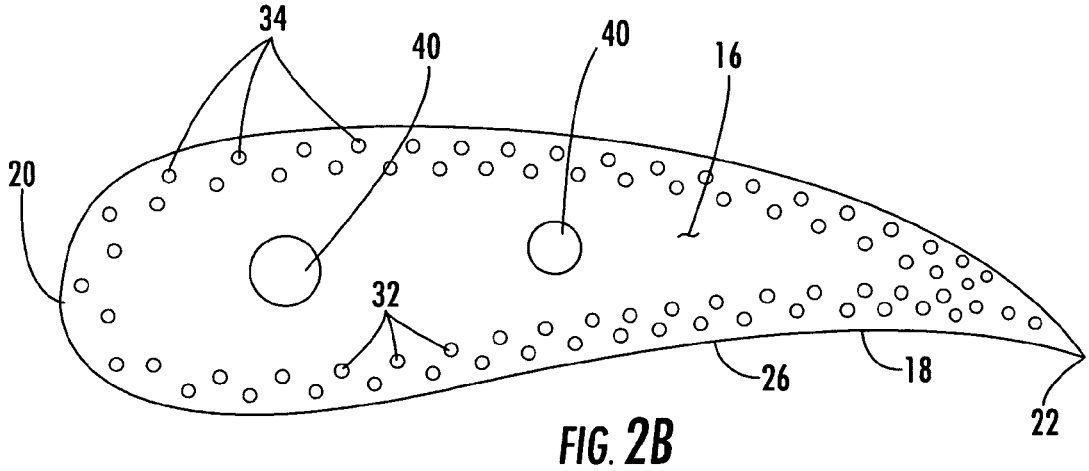
FIG. 2B is a top plan view of a two layer cooling hole arrangement for a turbine vane according to embodiments of the invention, showing an inner layer of cooling holes offset from an outer layer of cooling holes.

Similarly, the second layer of cooling holes 34 can extend radially between the inner radial end 14 and the outer radial end 16 of the vane 12. In one embodiment, at least one cooling hole in the second layer of cooling holes 34 can be substantially parallel to at least one cooling hole in the first layer of cooling holes 32. Further, as will be described later, the first and second layers of cooling holes 32, 34 can be in fluid communication with each other. The second layer of cooling holes 34 can be arranged about at least a portion of the vane 12. Relative to the first layer of cooling holes 32, the second layer of cooling holes 34 are closer to the outer peripheral surface 18 of the vane 12. When the second layer of cooling holes 34 extends about the entire vane 12, generally following the outer peripheral surface 18 of the vane 12, the second layer 34 can surround the first layer of cooling holes 32. The first and second layers of cooling holes 32, 34 can be substantially concentric. While the term concentric may connote a circular pattern, the layers of cooling holes 32, 34 are not limited to a circular pattern. Indeed, as shown in FIG. 2A, the first and second layers of cooling holes 32, 34 generally correspond to the shape of the outer peripheral surface 18 of the vane 12. Furthermore, the holes in one layer can be substantially aligned with the holes in another layer, as shown in FIG. 2A. Alternatively, at least some of the holes in one layer can be offset or staggered from at least a portion of the holes in another layer, as shown in FIG. 2B. The layers of cooling holes 32, 34 can be included in a vane 12 in any of a number of ways. For example, the cooling holes 32, 34 can be provided by drilling, punching, casting, cutting or other machining operation, as will be appreciated by one skilled in the art.

The cooling holes in each layer can be any of a number of shapes including circular, oval, oblong, rectangular, triangular and polygonal, just to name a few possibilities. In a given layer, the size and geometry of the holes can be substantially identical. However, one or more holes in the layer can be different in at least one of these respects. Further, the holes in a given layer can be arranged according to a pattern, regular or irregular, or to no particular pattern. For example, the holes in a layer can be spaced equidistantly from each other and/or relative to the outer peripheral surface 18 of the vane 12. The spacing between the holes in each layer can be substantially constant about the vane 12 or the spacing can vary. In one embodiment, the holes in a layer can be substantially equally spaced from each other. Further, at least one hole in the layer can be offset from the other holes.

Similarly, the geometry, size, and spacing of the cooling holes in one layer can be substantially identical to or different from the cooling holes in the another layer. The quantity of holes provided in the first layer 32 can be equal to the quantity of cooling holes provided in the second layer 34, but there need not be one to one correspondence of holes in the first and second layers 32, 34.

Figure 4:
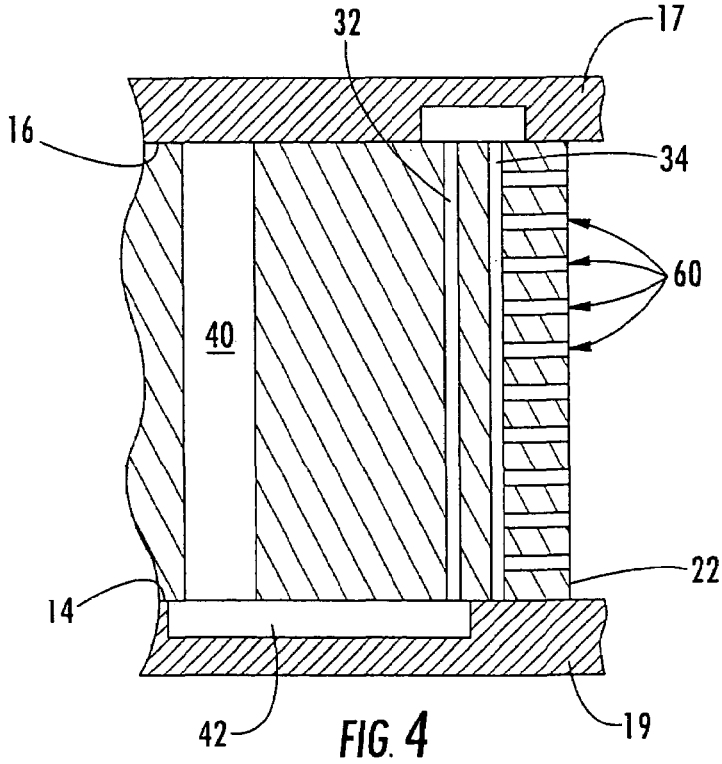
FIG. 4 is a cross-sectional view of a turbine vane, taken along line 4—4 in FIG. 2A, showing one possible trailing edge cooling system according to embodiments of the invention.

In addition to the layers of cooling holes, the vane 12 can include at least one radial coolant supply passage 40 in the vane 12 extending from the outer radial end 16 toward the inner radial end 14. In some instances, the radial coolant supply passage 40 can extend through the inner radial end 14 and/or the outer radial end 16. The coolant supply passage 40 can be spaced in from the first layer of cooling holes 32. In other words, the coolant supply passage 40 can be substantially surrounded by the first and second layers of cooling holes 32, 34. The coolant supply passage 40 can be in fluid communication with at least a portion of the first layer (i.e., the innermost layer) of cooling holes 32 at or near one end of the vane, such as at the inner radial end 14, as shown in FIG. 4. In one embodiment, the coolant supply passage 40 and the first layer of cooling holes 32 can extend through the radial inner end 14 of the vane 12. In such case, the inner shroud 19 can provide at least one plenum 42 or manifold for permitting fluid communication between the coolant supply passage 40 and the first layer of cooling holes 32.

In one embodiment, the coolant supply passage 40 can be an opening provided for receiving a fastener, such as a tie rod, for holding a stacked wafer vane 10*b* together. The coolant supply passage 40 can have any of a number of geometries including circular, oval, square and polygonal.

As noted earlier, the openings in the first and second layers 32, 34 can be in fluid communication with each other. Such fluid communication can occur at or near one of the radial ends of the vane, such as at the radial outer end 16. In one embodiment, at least one passage (not shown) can be provided within the vane 12 itself near its radial outer end 16 for permitting such fluid communication. The passage can be configured so as to direct the flow from the first layer 32 to the second layer 34 such that the direction of the coolant flow in the first layer 32 is substantially opposite the direction of the coolant flow in the second layer 34.

Figure 3:
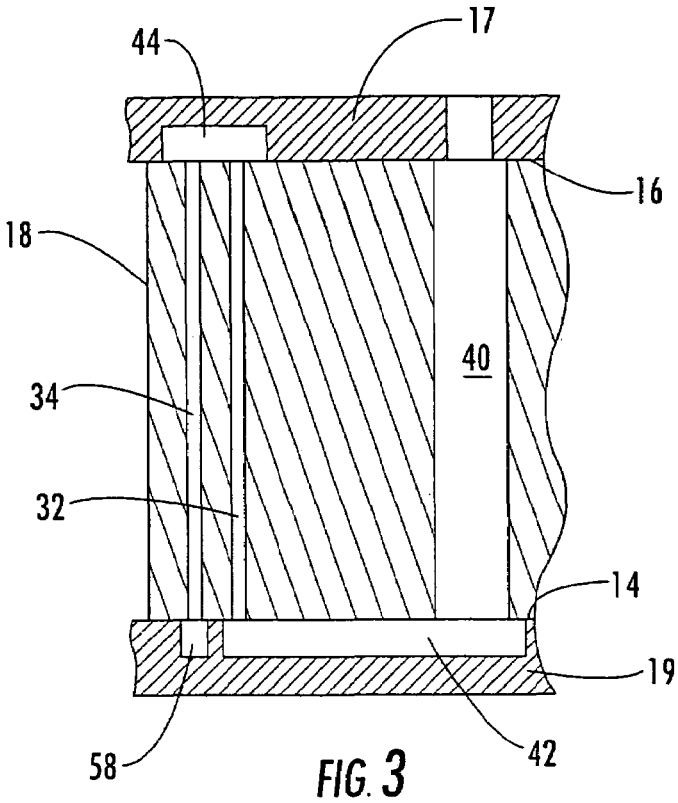
FIG. 3 is a cross-sectional view of a turbine vane, taken along line 3—3 in FIG. 2A, showing one possible coolant flow path through a cooling system according to embodiments of the invention.

In one embodiment, the first and second layers of cooling holes 32, 34 can extend through the radial outer end 16 of the vane 12, as shown in FIG. 3. In such case, the outer shroud 17 can provide a single plenum 44 for permitting fluid communication between the first and second layers of cooling holes 32, 34. Alternatively, the outer shroud 17 can provide at least two plenums. A first group of cooling holes in the first and second layers 32, 34 can fluidly communicate through a first plenum; other groups of cooling holes in the first and second layers 32, 34 can fluidly communicate through the other plenums. Alternatively, each individual cooling hole in the first layer 32 can fluidly communicate with an individual hole in the second layer 34 through a respective individual plenum provided in the outer shroud 17.

In the context of a two layer system, one manner of using a cooling system according to embodiments of the invention will now be described. First, a coolant, such as air, can be introduced in the coolant supply passage 40. The coolant can be, for example, high pressure air drawn from outside of the outer shroud 17. After flowing through the coolant supply passage 40, the coolant can enter the first or innermost layer of cooling passages 32 by a plenum 42 provided in the inner shroud 19. The coolant can pass radially through the first layer of cooling holes 32 and then into the second layer of cooling holes 34 by way of a plenum 44 provided in the outer shroud 17. As noted earlier, the plenums 42, 44 can be provided in the shrouds 17, 19 for permitting fluid communication between the first and second layers 32, 34, as shown in FIGS. 3 and 4; alternatively, channels can be provided in the vane 12 itself (not shown) to provide such fluid communication. The direction of coolant flow through the first layer 32 can be opposite to the direction of coolant flow through the second layer 34.

While the above discussion has focused on a vane 12 having a two layer cooling system, embodiments of the invention are not limited to two-layer cooling systems. If additional layers of cooling holes are provided, the coolant can sequentially progress through these passages. Once the coolant passes through the peripherally outermost layer of cooling holes, the coolant can be exhausted in a variety of manners, as will be described later.

Figure 2C:
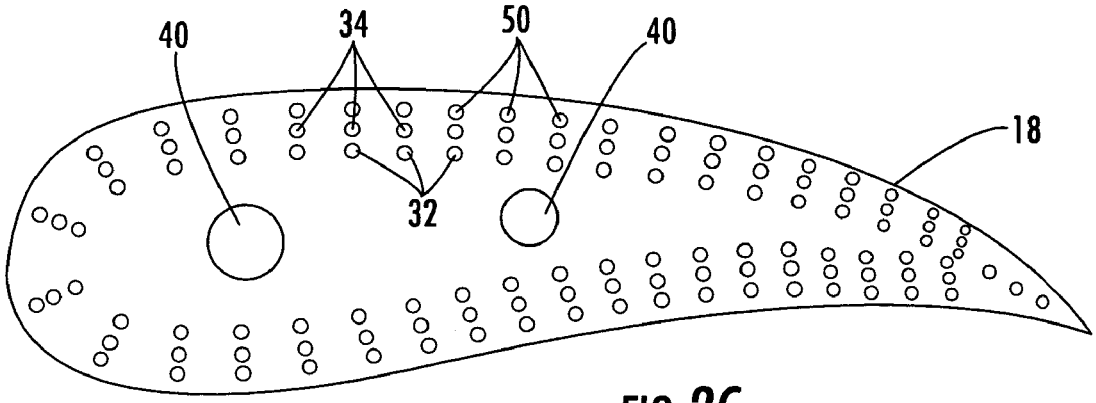
FIG. 2C is a top plan view of a three layer cooling hole arrangement for a turbine vane according to embodiments of the invention.
Figure 2D:
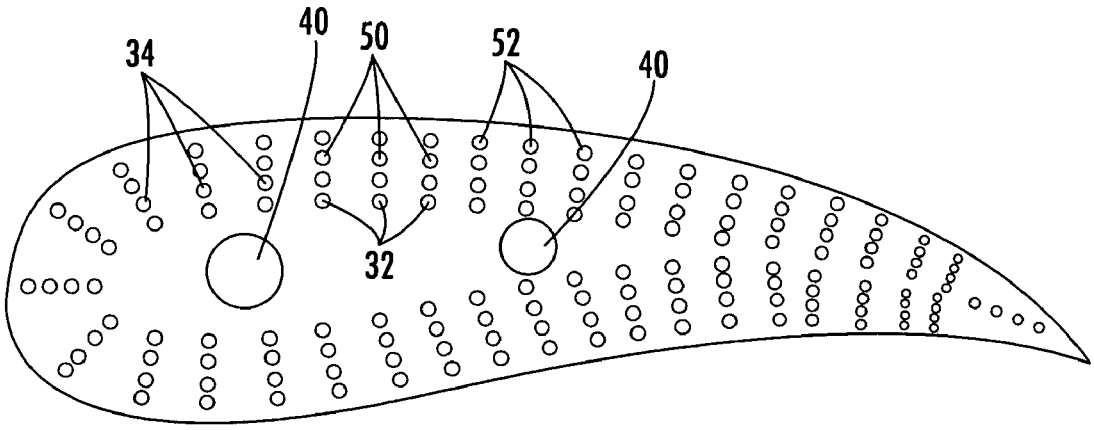
FIG. 2D is a top plan view of a four layer cooling hole arrangement for a turbine vane according to embodiments of the invention.

In one embodiment, shown in FIG. 2C, there can be a third layer of cooling holes 50 extending between the inner radial end 14 and the outer radial end 16 of the vane 12. The third layer of cooling holes 50 can be substantially parallel to the second layer of cooling holes 34. Moreover, the third layer of cooling holes 50 can be in fluid communication with the second layer of cooling holes 34 by way of, for example, a plenum (not shown) provided in the inner shroud 19. The third layer of cooling holes 50 can be arranged along at least a portion of the vane 12. The third layer 50 can be closer to the outer peripheral surface 18 than the second layer 34. The earlier discussion of the cooling holes in the first and/or second layers 32, 34 applies equally to the third layer of cooling holes 50. When there are three layers of cooling holes, a coolant can pass sequentially from the first layer 32 to the second layer 34 to the third layer 50 of cooling holes. The direction of coolant flow through the second layer 34 can be opposite to the direction of coolant flow through the first and third layers 32, 50. In other words, flow through the first and third layers 32, 50 can be in substantially the same direction, for example, flowing from the inner radial end 14 of the vane 12 to the outer radial end 16 of the vane 12.

Still other embodiments can include a fourth layer of cooling holes 52 extending between the inner radial end 14 and the outer radial end 16 of the vane 12. The fourth layer of cooling holes 52 can be substantially parallel to the third layer of cooling holes 50. Further, the fourth layer of cooling holes 52 can be in fluid communication with the third layer of cooling holes 50. The fourth layer of cooling holes 52 can be arranged along at least a portion of the vane 12. The fourth layer 52 can be closer to the outer peripheral surface 18 than the third layer 50. Again, the earlier discussion of the cooling holes in the first and/or second layers 32, 34 applies equally to the fourth layer of cooling holes 52. Thus, a coolant can pass sequentially through the first, second, third and fourth layers 32, 34, 50, 52 of cooling holes. The direction of coolant flow through the second and fourth layers 34, 52 can be opposite to the direction of coolant flow through the first and third layers 32, 50. For example, the coolant in the first and third layers 32, 50 can flow from the inner radial end 14 of the vane to the outer radial end 16 of the vane 12, while the coolant in the second and fourth layers 34, 52 can flow from the outer radial end 16 of the vane 12 to the inner radial end 14 of the vane 12.

The inclusion of third and/or fourth layers of cooling holes 50, 52 may require additional features to be included in the vane 12 or inner and outer shrouds 17, 19 to facilitate fluid communication between these outer layers. From the earlier description, one skilled in the art will appreciate the needed modifications that can be made to the vane and/or shrouds to facilitate such fluid communication.

Regardless of the number of layers of cooling holes, a coolant, after passing through the peripherally outermost layer can discharged from the system in a number of ways. For example, the coolant can be dumped into the turbine gas path or can be routed elsewhere in the engine for other purposes. In one embodiment, the coolant can be discharged from the system through one or more holes (not shown) in one of the shrouds 17, 19. The laminates 12 and/or one of the shrouds 17, 19 can provide one or more passages for routing the coolant to other places. For example, as shown in FIG. 3, passage 58 can be provided in the inner shroud 19 for routing a coolant exiting the second layer of cooling passages 34. In cases where the trailing edge 22 of the vane 12 requires a greater level of cooling than is provided by the layers of cooling holes, coolant from at least one of the holes in the outermost layer can be directed to a plurality of exhaust passages 60 provided in the trailing edge 22, such as shown in FIG. 4. The exhaust passages 60 can be formed in the outer peripheral surface 18 of the vane, such as substantially in the planar direction 28, and can be in fluid communication with at least one of the cooling holes in the outer layer. In such case, the outermost cooling hole can act as a plenum, passing the cooling air to the trailing edge as it flows into the turbine gas path. Alternatively, one or more plenums, manifolds or passages 58 can be provided within the vane 12 itself or in one of the shrouds 17, 19 to route the coolant from the outer layer of cooling holes to the exhaust passages 60 at the trailing edge 22.

Preferably when cooling of the trailing edge 22 is crucial, a trailing edge supply plenum, which can be at least one set of cooling holes from the layers can be enlarged and supplied with extra cooling air. Ideally, the trailing edge supply plenum is configured so as not to be interrupted by any breaches or leaks that might occur in other regions of the vane. This can be accomplished by providing an individual plenum connecting a single cooling hole in the first layer to a single cooling hole in the second layer as discussed earlier. Alternatively, a dedicated plenum can be provided, such as one of the holes 40 provided to receive a tie bolt for holding the stacked wafer vane **10*b*** together.

Aside from cooling benefits, a fail safe cooling system according to embodiments can provides a margin of safety in situations that might otherwise result in a catastrophic failure in the turbine. For instance, an object may impact the exterior surface of the vane, causing surface damage. If the damage penetrates deep enough, a portion of the outer layer of cooling holes may be exposed. In conventional vane designs, penetration of the internal cooling passages of the vane can quickly progress to major structural damage. However, a cooling system according to the invention can avoid or at least delay the occurrence of such sever consequences long enough so that the problem can be detected. While there may be coolant losses through the damaged areas and aerodynamic disturbances in the turbine gas path, thereby decreasing engine efficiency, a catastrophic failure can be avoided because the cooling system will continue to provide cooling to the affected area and also to the unaffected areas of the vane.

As mentioned earlier, it is preferred if a cooling system according to embodiments of the invention is used on vanes made of stacked anisotropic CMC laminates. Such a material and construction can provide additional robustness to the cooling system. For instance, if, for some unplanned reason, an extreme hot spot develops at some surface location of the vane, that portion of the CMC would undergo additional sintering, causing a local thickness shrinkage of the affected lamina. Because of the anisotropic shrinkage typical of the CMC, the shrinkage would be most significant in the radial direction. Thus, due to the shrinkage, a small gap may open up locally between the affected lamina, resulting in a leakage of cooling air through the gap. This leakage would, however, provide additional cooling to the affected area, thereby self correcting the overheat situation, and thereby maintaining the structural integrity of the components so long as sufficient cooling air continues to be delivered to the area. If the cooling air use is monitored for individual vanes, any such problem would be detected and could be corrected on a scheduled shut down.

The foregoing description is provided in the context of one vane assembly according to embodiments of the invention. Of course, aspects of the invention can be employed with respect to myriad vane designs, including all of those described above, as one skilled in the art would appreciate. Embodiments of the invention may have application to other hot gas path components of a turbine engine. For example, the same stacked laminate construction can be applied to the inner and outer platforms or shrouds of the vane by changing the shape of the laminates so as to build up the required platform or shroud geometry. Thus, it will of course be understood that the invention is not limited to the specific details described herein, which are given by way of example only, and that various modifications and alterations are possible within the scope of the invention as defined in the following claims.

What is claimed is:

1. A fail safe cooling system for a turbine vane, comprising:

a turbine vane having an outer radial end, an inner radial end and an outer peripheral surface defining an outer vane profile;

a first layer of cooling holes extending substantially radially between the inner radial end and the outer radial end of the vane, the first layer of cooling holes being arranged along at least a portion of the vane;

a second layer of cooling holes extending substantially radially between the inner radial end and the outer radial end of the vane, the second layer of cooling holes being arranged along at least a portion of the vane, the second layer of cooling holes being in fluid communication with the first layer of cooling holes near one of the radial ends, wherein the second layer is closer to the outer peripheral surface than the first layer; and at least one radial coolant supply passage in the vane extending from the outer radial end toward the inner radial end, the coolant supply passage being spaced inward from the first layer of cooling holes, wherein the coolant supply passage is in fluid communication with the first layer of cooling holes, whereby a coolant can pass sequentially from the first layer to the second layer of cooling holes with the direction of coolant flow through the first layer being opposite to the direction of coolant flow through the second layer.

2. The cooling system of claim 1 further including a third layer of cooling holes extending between the inner radial end and the outer radial end of the vane, the third layer of cooling holes being in fluid communication with the second layer of cooling holes, the third layer of cooling holes arranged along at least a portion of the vane, wherein the third layer is closer to the outer peripheral surface than the second layer, whereby a coolant can pass sequentially from the first layer to the second layer to the third layer of cooling holes with the direction of coolant flow through the second layer being opposite to the direction of coolant flow through the first and third layers.

3. The cooling system of claim 2 further including a fourth layer of cooling holes extending between the inner radial end and the outer radial end of the vane, the fourth layer of cooling holes being in fluid communication with the third layer of cooling holes, the fourth layer of cooling holes arranged along at least a portion of the vane, wherein the fourth layer is closer to the outer peripheral surface than the third layer, whereby a coolant can pass sequentially through the first, second, third and fourth layers of cooling holes with the direction of coolant flow through the second and fourth layers being opposite to the direction of coolant flow through the first and third layers.

4. The cooling system of claim 1 wherein the first and second layers of cooling holes are substantially concentric.

5. The cooling system of claim 1 wherein the vane provides at least one passage near its radial inner end for permitting fluid communication between the coolant supply passage and the first layer of cooling holes.

6. The cooling system of claim 5 wherein the vane further provides at least one passage near its radial outer end for permitting fluid communication between the first and second layers of cooling holes.

7. The cooling system of claim 1 wherein the vane is bounded at its inner radial end by an inner shroud, the coolant supply passage and the first layer of cooling holes extending through the radial inner end of the vane, the inner shrbud providing at least one plenum for permitting fluid communication between the coolant supply passage and the first layer of cooling holes.

8. The cooling system of claim 1 wherein the vane is bounded at its outer radial end by an outer shroud, the first and second layers of cooling holes extending through the radial outer end of the vane, the outer shroud providing a single plenum for permitting fluid communication between the first and second layers of cooling holes.

9. The cooling system of claim 1 wherein the vane is bounded at its outer radial end by an outer shroud, the first and second layers of cooling holes extending through the radial outer end of the vane, the outer shroud providing at least two plenums, wherein a first group of cooling holes in the first and second layers fluidly communicate through a first plenum, a second group of cooling holes in the first and second layers fluidly communicate through a second plenum.

10. The cooling system of claim 1 wherein the vane is bounded at its outer radial end by an outer shroud, the first and second layers of cooling holes extending through the radial outer end of the vane, wherein each individual cooling hole in the first layer fluidly communicates with an individual hole in the second layer through a respective individual plenum provided in the outer shroud.

11. The cooling system of claim 1 wherein the vane includes a trailing edge, at least one of the cooling holes in the second layer includes a plurality of channels branching therefrom and extending through the trailing edge of the vane, whereby the channels can provide cooling to the trailing edge of the vane.

12. The cooling system of claim 1 wherein the vane is a single-piece construction.

13. The cooling system of claim 1 wherein the vane is made of a plurality of laminates each having an airfoil-shaped outer peripheral surface, the laminates being radially stacked so as to form the turbine vane.

14. The cooling system of claim 13 wherein each laminate has a planar direction and a radial direction, the radial direction being substantially normal to the planar direction, each laminate being made of an anisotropic ceramic matrix composite (CMC) material, wherein the planar tensile strength of each laminate is substantially greater than the radial tensile strength of the laminate.

15. A turbine vane with fail safe cooling comprising:

a turbine vane having an outer radial end, an inner radial end and an outer peripheral surface, at least one coolant supply passage extending radially through the vane, the vane being formed by a plurality of laminates having an airfoil-shaped outer peripheral surface, the laminates being radially stacked so as to define the turbine vane, each laminate being made of an anisotropic ceramic matrix composite (CMC) material, wherein each laminate has a planar direction and a radial direction that is substantially normal to the planar direction, wherein the planar tensile strength of each laminate is substantially greater than the radial tensile strength of the laminate;

an outer shroud bounding the vane at its outer radial end;

an inner shroud bounding the vane at its inner radial end;

a first layer of cooling holes extending radially through the vane, the first layer of cooling holes being arranged about at least a portion of the vane, the first layer of cooling holes being in fluid communication with the at least one coolant supply passage through at least one plenum provided in the inner shroud;

a second layer of cooling holes extending radially through the vane, the second layer of cooling holes being in fluid communication with the first layer of cooling holes through at least one plenum in the outer shroud, the second layer of cooling holes being arranged about at least a portion of the vane, wherein the second layer is closer to the outer peripheral surface than the first layer, whereby a coolant can pass sequentially from the first layer to the second layer of cooling holes with the direction of coolant flow through the first layer being opposite to the direction of coolant flow through the second layer.

16. The vane of claim 15 further including a third layer of cooling holes extending between the inner radial end and the outer radial end of the vane, the third layer of cooling holes being in fluid communication with the second layer of cooling holes through at least one plenum in the inner shroud, the third layer of cooling holes being arranged about at least a portion of the vane, wherein the third layer is closer to the outer peripheral surface than the second layer, whereby a coolant can pass sequentially from the first layer to the second layer to the third layer of cooling holes with the direction of coolant flow through the second layer being opposite to the direction of coolant flow through the first and third layers.

17. The vane of claim 15 wherein the vane includes a trailing edge and a plurality of exit passages formed therein in substantially the planar direction, the second layer of cooling holes being in fluid communication with the trailing edge exit passages by way of at least one plenum in the inner shroud.

18. The vane of claim 15 wherein the vane includes a trailing edge, wherein at least one pair of cooling holes from the first and second layers positioned proximate the trailing edge, wherein the cooling hole of the second layer includes a plurality of exit passages extending therefrom and through the trailing edge.

19. The vane of claim 15 wherein a fastener is received in the coolant supply passage for maintaining the laminate stack in radial compression.

* * * * *